US007908939B2

(12) United States Patent
Kim et al.

(10) Patent No.: US 7,908,939 B2
(45) **Date of Patent: *Mar. 22, 2011**

(54) ACCELERATOR PEDAL

(75) Inventors: Kyung Min Kim, Busan (KR); Kwang Hyuck Lee, Busan (KR); Yong Hwan Mo, Ulsan (KR)

(73) Assignee: Donghee Industrial Co., Ltd., Ulsan Metropolitan (KR)

( * ) Notice: Subject to any disclaimer, the term of this patent is extended or adjusted under 35 U.S.C. 154(b) by 1094 days.

This patent is subject to a terminal disclaimer.

(21) Appl. No.: 11/637,583

(22) Filed: Dec. 12, 2006

(65) Prior Publication Data

US 2007/0151398 A1 Jul. 5, 2007

(30) Foreign Application Priority Data

Dec. 13, 2005 (KR) ..... 10-2005-0122741

(51) Int. Cl.
*G05G 1/30* (2008.04)

(52) U.S. Cl. ..... 74/513; 74/512

(58) Field of Classification Search ..... 74/512–514, 74/560, 478; 180/334

See application file for complete search history.

(56) References Cited

U.S. PATENT DOCUMENTS

| | | | | |
|---|---|---|---|---|
| 5,497,677 | A | 3/1996 | Baumann et al. | |
| 6,318,208 | B1 * | 11/2001 | Thongs et al. | 74/513 |
| 7,044,019 | B2 | 5/2006 | Hauschopp et al. | |
| 7,296,494 | B2 * | 11/2007 | Caba et al. | 74/513 |
| 7,503,236 | B2 * | 3/2009 | Schlabach | 74/513 |
| 7,631,574 | B2 * | 12/2009 | Leone | 74/513 |
| 7,717,012 | B2 * | 5/2010 | Kim et al. | 74/512 |
| 2010/0077886 | A1 * | 4/2010 | Seiltz et al. | 74/513 |

FOREIGN PATENT DOCUMENTS

| | | |
|---|---|---|
| DE | 101 21 317 A1 * | 11/2002 |
| EP | 0 670 235 | 9/1995 |
| JP | 3-124204 | 5/1991 |
| JP | 4-69004 | 3/1992 |

* cited by examiner

*Primary Examiner* — Vinh T. Luong

(74) *Attorney, Agent, or Firm* — Hamre, Schumann, Mueller & Larson, P.C.

(57) ABSTRACT

An accelerator pedal which has a housing; a foot plate coupled hingedly with the housing; a pedal arm; a carrier that penetrates the housing to connect the foot plate and the pedal arm; a compression spring to apply restoring force to the carrier; and a cover. The accelerator pedal has a plate coupling part that extends from a body of the housing. The foot plate has a first end is inserted into a coupling hole of the plate coupling part and is coupled hingedly with the housing. The compression spring is disposed between a lower side of the body of the housing and the carrier.

4 Claims, 7 Drawing Sheets

ACCELERATOR PEDAL

BACKGROUND OF THE INVENTION

1. Field of the Invention

The present invention relates to a mechanical organ type accelerator pedal, and particularly, to a mechanical organ type accelerator pedal to improve an operation feeling and reduce driver's fatigue while achieving stability and economic feasibility.

2. Description of the Related Art

Generally, an accelerator pedal of a vehicle is a device which regulates an inhalation quantity of fuel-air mixture in a gasoline engine, and regulates an injection quantity of fuel in a diesel engine, to control number of revolution of an engine. The accelerator is classified into a pendant type which is hung on a dashboard and an organ type which is disposed on a floor panel depending on a mounting structure.

Recently, a mechanical accelerator pedal is widely used to control the quantity of combustion by opening/closing a throttle valve in a carburetor through an acceleration cable.

However, a conventional mechanical accelerator pedal gives a driver a rough operation feeling, accordingly, a problem is found in that the rough operation feeling increases driver's fatigue.

In addition, since the opening/closing of the throttle valve cannot be operated with accuracy, unexpected waste of fuel is inevitably generated, thus making worse fuel efficiency as well as stability.

SUMMARY OF THE INVENTION

The present invention has been devised to solve the above problem. An object of the present invention is to provide a mechanical organ type accelerator pedal in which an organ type pedal is employed to serve as a mechanical accelerator pedal while maintaining the function of the mechanical accelerator pedal which controls an opening/closing operation of a throttle valve in a carburetor through an acceleration cable to improve an operation feeling and thus reduce driver's fatigue, and to enable an accurate operation of the throttle valve to achieve stability and economic feasibility, and to improve the interior look to upgrade a vehicle.

In order to accomplish the above object, the present invention provides a mechanical organ type accelerator pedal which includes: a housing that is fixedly disposed to a floor panel under a driver's seat; a foot plate whose one end is coupled hingedly with the housing and the other end is disposed to be rotated in a vertical direction of the housing by driver's stepping force on the pedal; a pedal arm that is coupled with one end of a connecting cable connected to an acceleration cable and disposed to be rotatable inside the housing in conjunction with the operation of the foot plate; a carrier that penetrates the housing to connect the foot plate and the pedal arm an elastic means that is disposed to be supported by the housing and the carrier at both ends to apply restoring force to the carrier; and a cover that is coupled with the housing to cover an opening at one side of the housing and has a center protrusion at one side, the center protrusion being inserted in the center part of the carrier and serving as a rotating fulcrum.

BRIEF DESCRIPTION OF THE DRAWINGS

The above and other features and advantages of the present invention will become more apparent by describing preferred embodiments thereof in detail with reference to the attached drawings in which.

DESCRIPTION OF THE PREFERRED EMBODIMENTS

Hereinafter, embodiments of the invention will be described with reference to the accompanying drawings.

Figure 1:
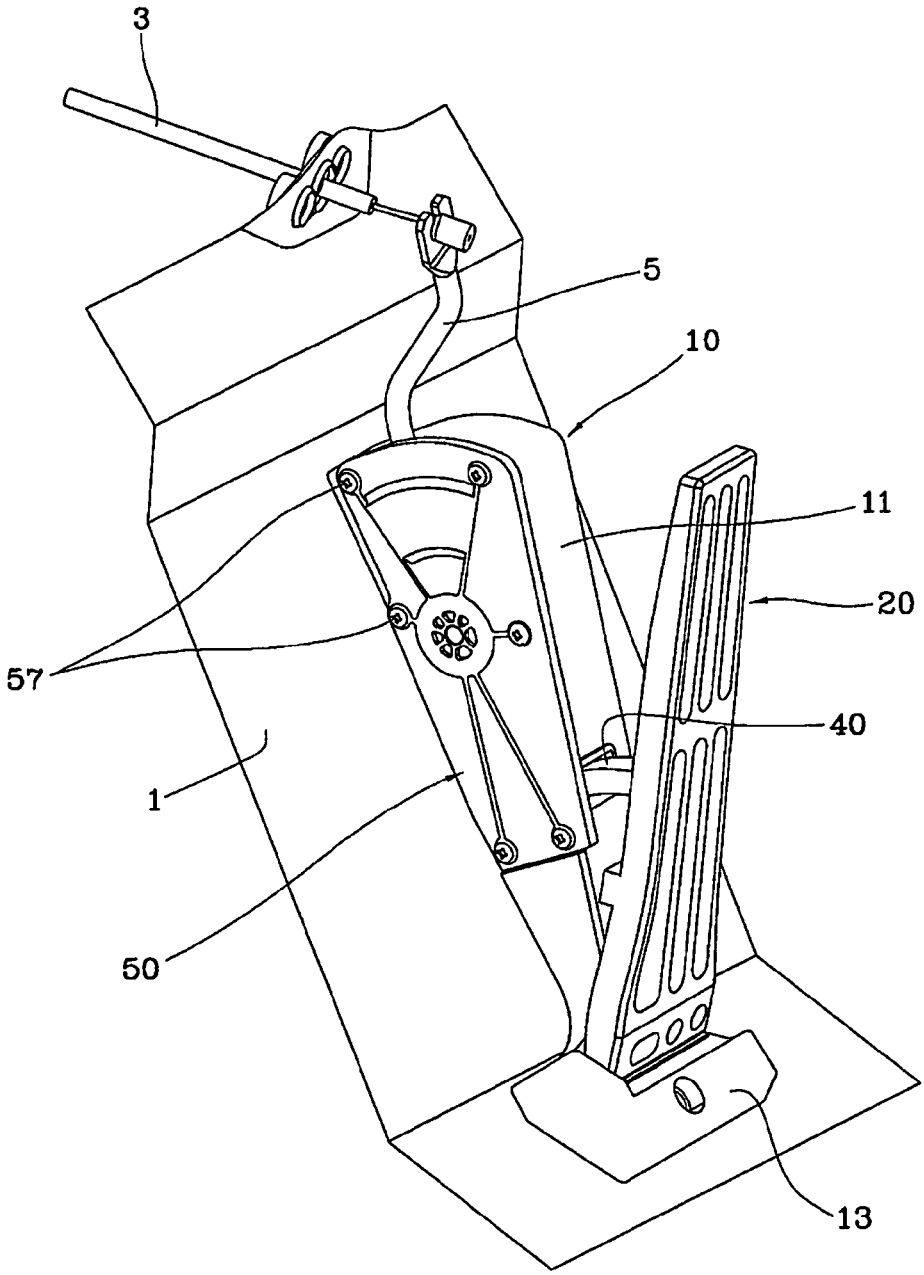
FIG. 1 is a perspective view illustrating a mechanical organ type accelerator pedal according to the present invention.
Figure 2:
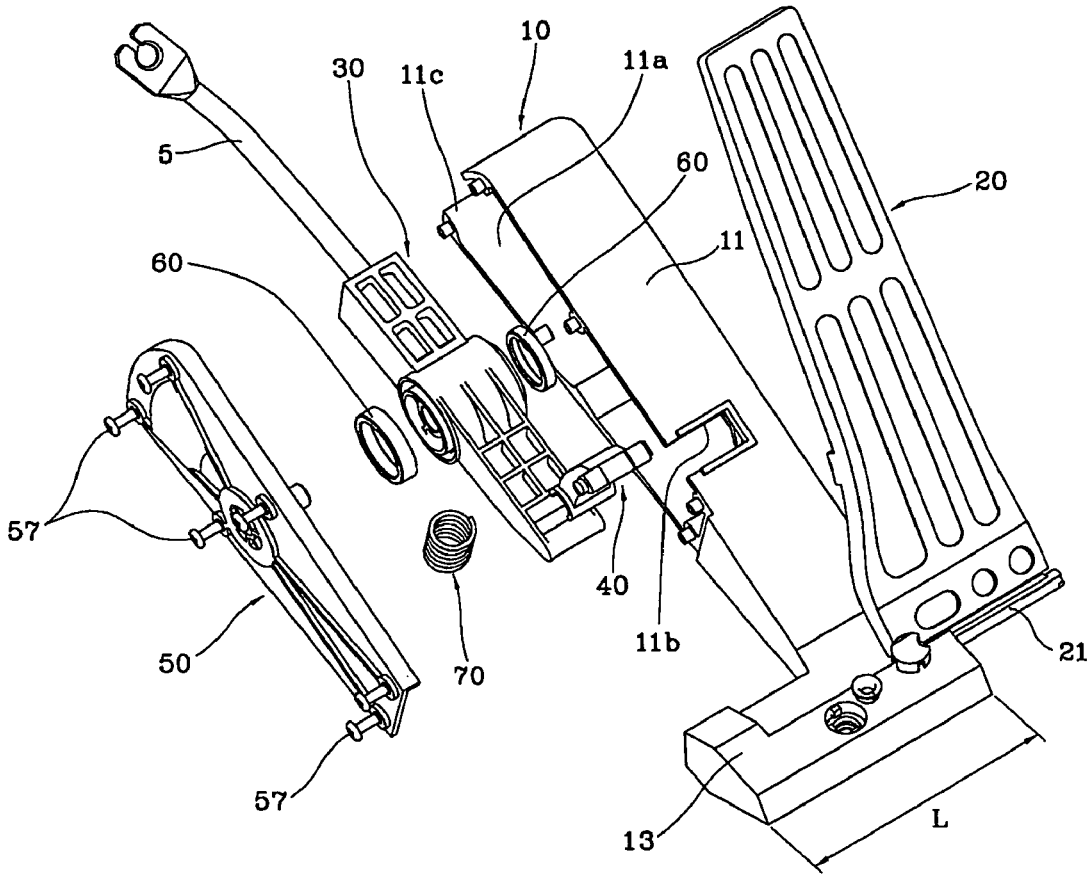
FIG. 2 is an exploded perspective view of the mechanical organ type accelerator pedal according to the present invention.

FIG. 1 is a perspective view illustrating a mechanical organ type accelerator pedal according to the present invention.

A mechanical organ type accelerator pedal according to the present invention, as shown in FIGS. 1 to 6, is composed of a housing 10 that is fixedly disposed to a floor panel 1 under a driver's seat, a foot plate 20 whose one end is coupled hingedly with the housing 10 and the other end is disposed to be rotated in a vertical direction of the housing 10 by driver's stepping force on the pedal, a pedal arm 30 that is coupled with one end of a connecting cable 5 connected to an acceleration cable 3 and disposed to be rotatable inside the housing 10 in conjunction with the operation of the foot plate 20, a carrier 40 that penetrates the housing 10 to connect the foot plate 20 and the pedal arm 30, an elastic means that is disposed to be supported by the housing 10 and the carrier 40 at both ends to apply restoring force to the carrier 40, and a cover 50 that is coupled with the housing 10 to cover an opening at one side of the housing 10 and a center protrusion 51 is formed at one side of the cover 50 so as to be inserted in the center part of the carrier 40 and to serve as a rotating fulcrum.

Here, in the mechanical organ type accelerator pedal according to the invention, when the connecting cable 5 pulls the acceleration cable 3 in accordance with the operation of the pedal arm 30, a throttle valve is opened to control the quantity of combustion.

In the meantime, the housing 10 is composed of a body 11 and a plate coupling part 13.

The body 11 has an accommodation space 11*a* therein to accommodate the pedal arm 30 and the elastic means. An upper side of the body facing the foot plate 20 in the accommodation space 11*a* has a carrier hole 11*b* through which the carrier 40 passes, and a front side of the body facing the acceleration cable 3 in the accommodation space 11*a* has a cable hole 11*c* through which the connecting cable 5 passes.

In addition, the cover 50 is coupled with the body 11 at one side by using a plurality of screws 57 to cover the accommodation space 11*a*.

The plate coupling part 13 is formed to extend from the body 11, and a coupling hole 13*a* that is opened in one direction is formed in the width direction L.

Figure 3A:
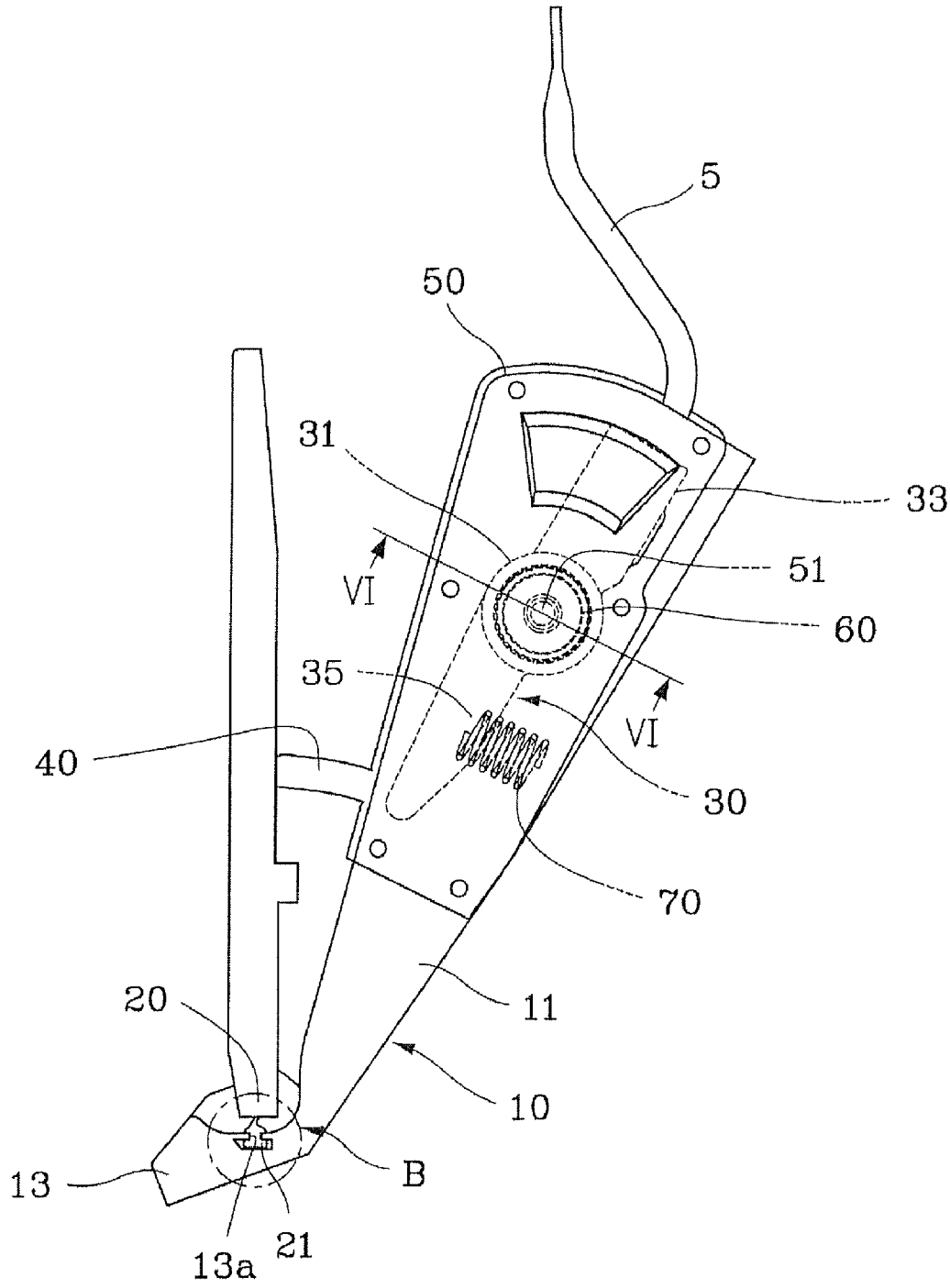
FIG. 3A is a right side view illustrating an assembly of the pedal of FIG. 2.
Figure 3B:
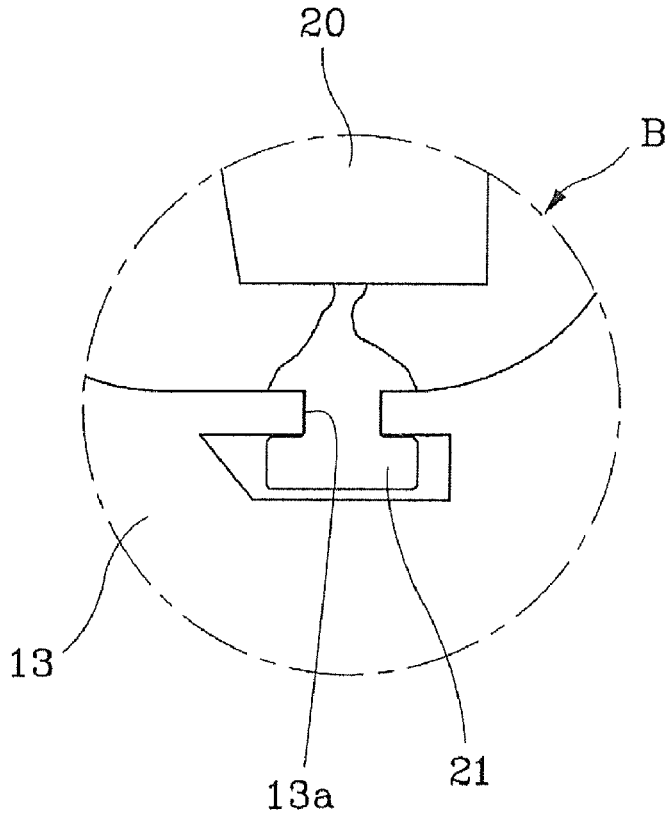
FIG. 3B is an enlarged view of portion B shown in FIG. 3A.
Figure 4:
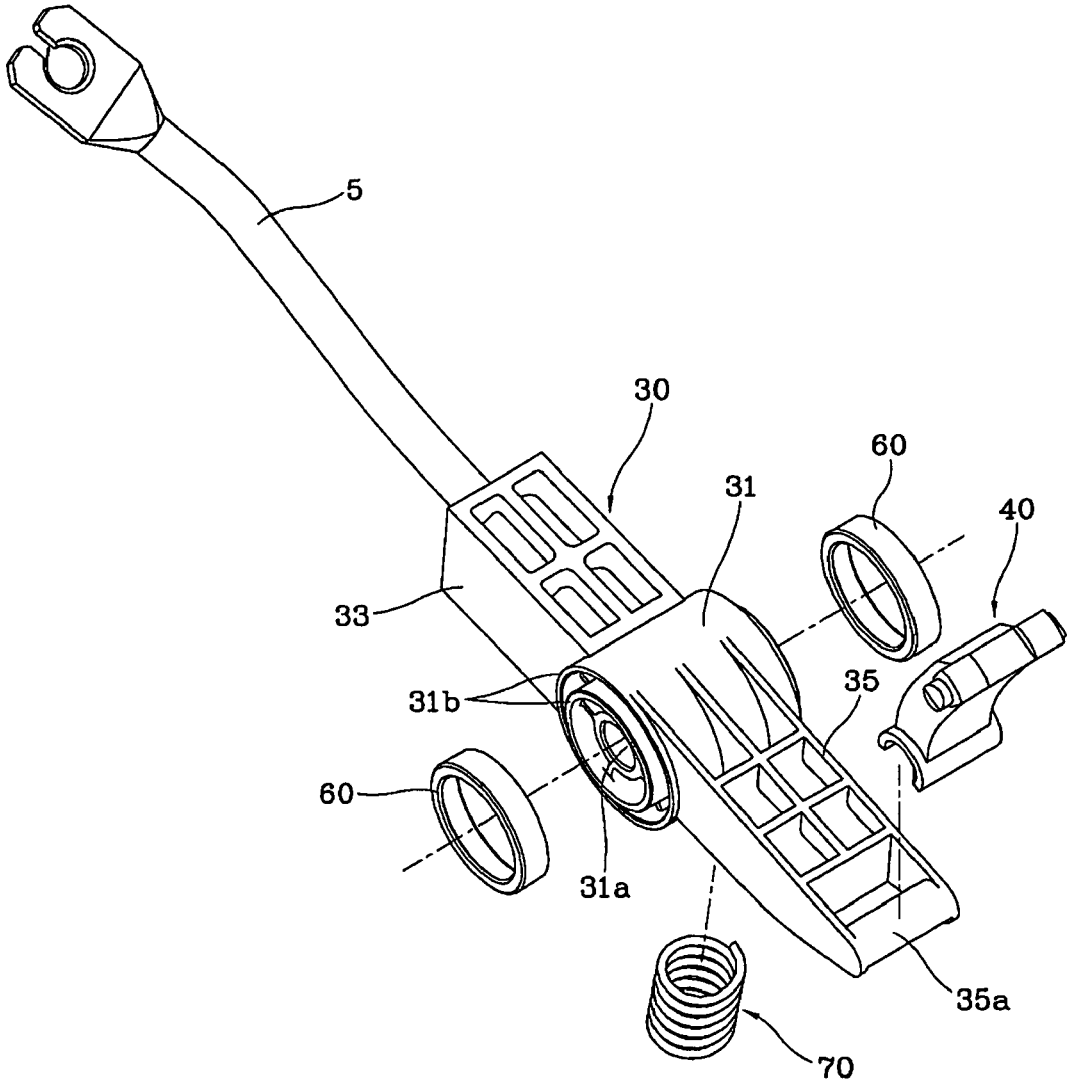
FIG. 4 is an exploded perspective view illustrating a pedal arm and a carrier in the pedal of FIG. 2.
Figure 5:
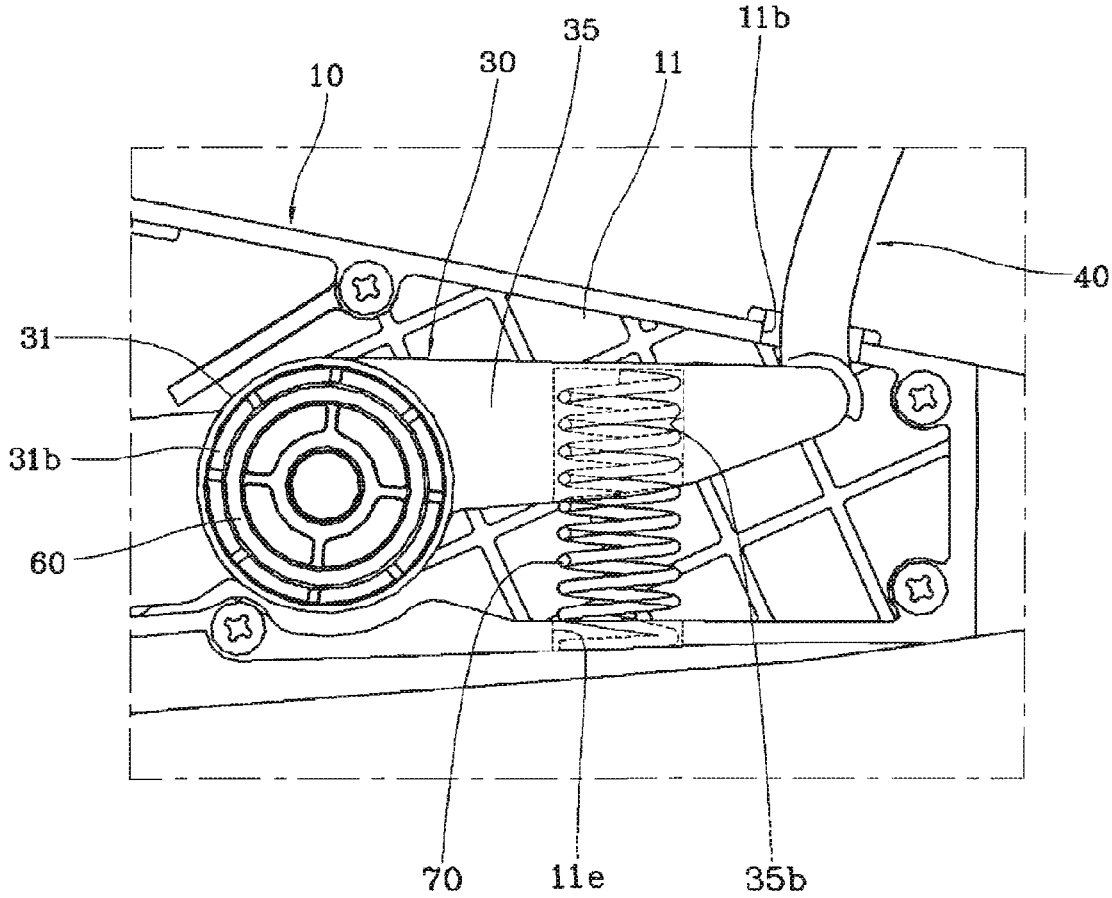
FIG. 5 is a partial enlarged view illustrating an elastic means disposed in the device of FIG. 2.
Figure 6:
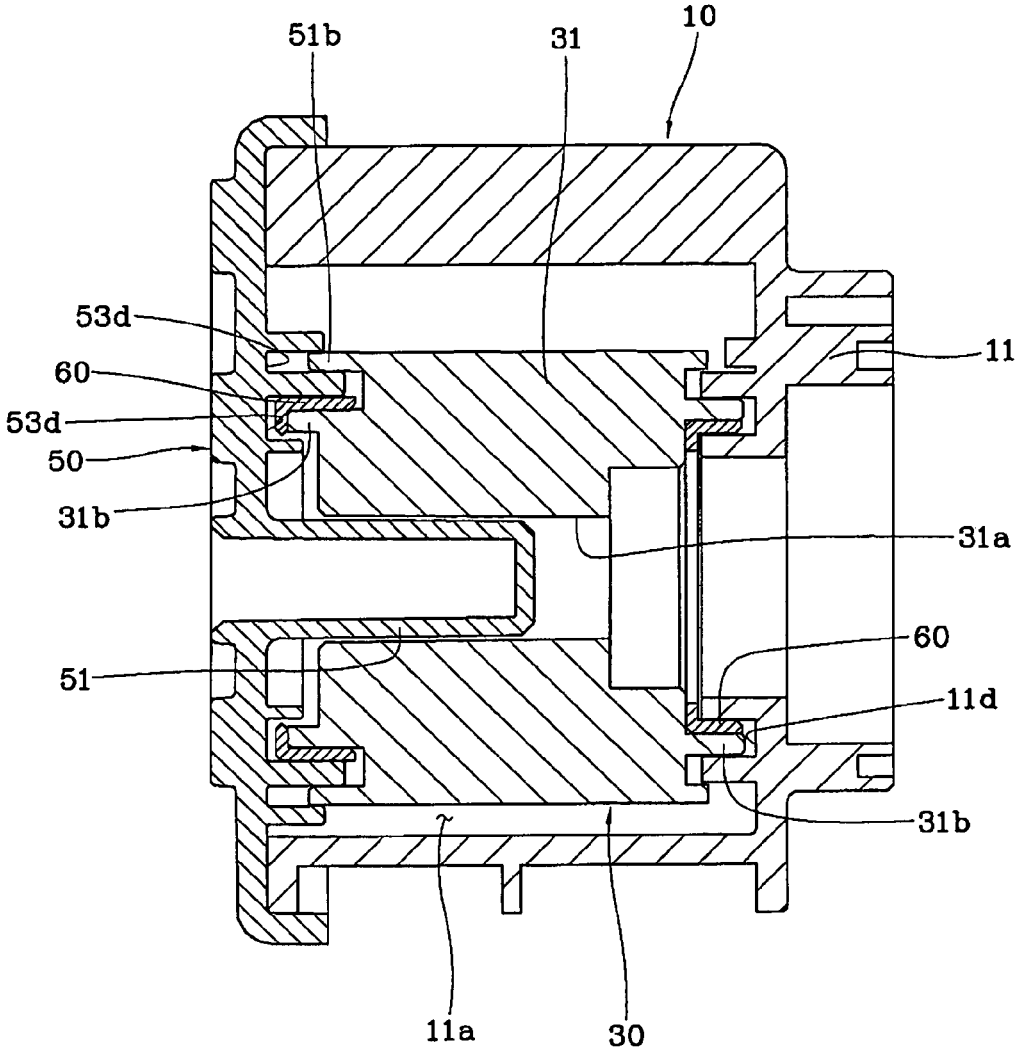
FIG. 6 is a partial cross-sectional view taken along the line VI-VI of FIG. 3A, illustrating the coupled condition of the pedal arm.

As shown in FIG. 3B, which is an enlarged view of portion B in FIG. 3A, one end of the foot plate 20 is inserted in the coupling hole 13*a*. Particularly, a hinge film 21 that is integrated to one end of the foot plate 20 is inserted in the coupling hole 13*a* to serve as a hinge.

The pedal arm 30 is composed of the cylindrical part 31 which is formed by forming a flange 31*b* in a circumferential direction around a protrusion hole 31*a* to protrude in a lateral direction, a protrusion hole 31*a* being located between the carrier hole 11*b* and the cable hole 11*c* in the accommodation space 11*a*, and is formed through the center portion at both sides of a cylinder part 31 such that the center protrusion 51 of the cover 50 is inserted in the protrusion hole, a front arm 33 which is formed to extend toward the cable hole 11*c* from the outer surface of the cylindrical part 31 and coupled with the connecting cable 5 at a leading end of the front arm, and a rear arm 35 which is formed to extend toward the carrier hole 11*b* from the outer surface of the cylindrical part 31 and coupled with the lower end of the carrier 40 at a leading end of the rear arm.

As the center protrusion 51 of the cover 50 is inserted in the protrusion hole 31*a* of the cylindrical part 31, the pedal arm 30 is able to seesaw inside the accommodation space 11*a* when an external force is applied.

In the meantime, the flange 31*b* formed at both side surfaces of the cylindrical part 31 is inserted in flange holes 11*d* and 53*d* formed in the body 11 of the housing 10 and the cover 50, respectively, to be coupled therewith.

Here, a bushing 60 is inserted between the flange 31*b* and the flange holes 11*d* and 53*d*, and the bushing 60 prevents abrasion arising from friction.

The carrier 40 is disposed to penetrate the carrier hole 11*b*, and the upper end of the carrier is coupled with the foot plate 20 and the lower end of the carrier is coupled with the rear arm 35 of the pedal arm 30.

Here, the lower end of the carrier 40 is formed in a fork shape to be fitted with a rod 35*a* which is provided at the end of the rear arm 35.

In addition, the carrier 40 serves to prevent the foot plate 20 from being rotated by its weight and thus overlapped on the housing 10.

A compression spring 70 is used as the elastic means, the upper end of the compression spring 70 is inserted in an upper hole 35*b* formed at the lower side of the rear arm 35, and the lower end of the compression spring is inserted in a lower hole 11*e* formed at the lower side of the body 11 in the accommodation space 11*a*.

Although the number of the compression spring 70 is one in the present invention, it is not limited thereto; for example, a double structure in which two springs having different diameters are overlapped with each other may be provided if necessary.

Hereinafter, operation and effect according to the embodiment of the invention will be described.

When a driver steps on the foot plate 20, the foot plate 20 rotates toward the housing 10 by the hinge film 21, and thus the carrier 40 descends.

The descent of the carrier 40 causes a rotation arm 30 to rotate clockwise with respect to the center protrusion 51, from the condition shown in FIG. 3A, and at this moment, the compression spring 70 is deformed such that the entire length is shortened.

As the rotation arm 30 rotates, the connecting cable 5 is pulled, and accordingly the acceleration cable 3 is pulled in conjunction with the connecting cable so as to open/close the throttle valve, thereby controlling the quantity of combustion.

When the foot of the driver is removed from the foot plate 20, the rotation arm 30 is rotated counterclockwise by restoring force of the compression spring 70, and the carrier 40 ascends, and the foot plate 20 is rotated away from the housing 10 so as to return to an initial position.

At this moment, the connecting cable 5 and the acceleration cable 3 that are pulled toward the housing 10 return to an initial position to prepare for the next operation.

In addition, when the foot plate 20 is reversely rotated, the maximum rotation angle is restricted by the carrier 40; therefore, the foot plate 20 returns to the initial position at all times to prepare for the next operation.

Therefore, in the mechanical organ type accelerator pedal according to the invention, an organ type pedal is employed to serve as a mechanical accelerator pedal while maintaining the function of the mechanical accelerator pedal which controls an opening/closing operation of a throttle valve in a carburetor through an acceleration cable to improve an operation feeling and thus reduce driver's fatigue.

In addition, an accurate operation of the throttle valve is enabled by the improved operation feeling, and unexpected waste of fuel is reduced to achieve economic feasibility.

Further, the mechanical organ type accelerator pedal according to the invention has an improved stability.

That is, the foot plate 20 which is rotated toward the housing 10 by driver's stepping force on the pedal rotates reversely away from the housing 10 when the foot of the driver is removed from the pedal so as to return to the initial position. At this time, if a driver's shoe or cloth is caught on the foot plate 20, the foot plate 20 deviates from a normal condition shown in FIG. 4, and is pulled back completely.

The above-described case may occur when a vehicle travels on a steep incline.

However, according to the invention, since the carrier 40 restricts the maximum rotation angle of the reverse rotation of the foot plate 20, the foot plate 20 is prevented from deviating from the normal condition and being pulled back completely as described above, thereby improving stability of the vehicle.

On the contrary, when the vehicle travels on a steep downhill road, the foot plate 20 is forced to rotate toward the housing 10 by its weight, but the carrier 40 which has received force from the compression spring 70 through the pedal arm 30 restricts the rotation of the foot plate 20, thus improving stability of operation.

As described above, the mechanical organ type accelerator pedal according to the present invention improves an operation feeling and reduces driver's fatigue, and improves fuel efficiency by improving fuel consumption ratio, and improves stability via the compression spring and the carrier which restricts the maximum angle of the reverse rotation of the foot plate.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An accelerator pedal, comprising:

a housing fixedly disposed to a floor panel under a driver's seat, the housing including:

a body including:

an accommodation space, an upper side of the body facing a foot plate, the upper side of the body including a carrier hole through which a carrier passes, a front side of the body facing an acceleration cable, the front side of the body including a cable hole through which a connecting cable passes, and a lower side of the body, a plate coupling part extending from the body, the plate coupling part including:

a coupling hole located at a side of the plate coupling part, the coupling hole extending along a width direction of the plate coupling part;

the foot plate including a first end is inserted into the coupling hole of the plate coupling part and being coupled hingedly with the housing, and a second end being movable towards the housing by a driver's stepping force on the accelerator pedal;

a pedal arm disposed in the accommodation space, the pedal arm coupled with an end of the connecting cable, the connecting cable connected to the acceleration cable, the pedal arm being configured to be rotatable inside the housing in conjunction with an operation of the foot plate, the pedal arm including:

a cylindrical part including a flange in a circumferential direction around a protrusion hole to protrude in a lateral direction, the protrusion hole being located between the carrier hole and the cable hole in the accommodation space and formed through the center portion at both sides of the cylinder part, a front arm extending from an outer surface of the cylindrical part towards the cable hole and coupled with the connecting cable at a leading end of the front arm, and a rear arm extending from the outer surface of the cylindrical part towards the carrier hole and coupled with a lower end of a carrier at a leading end of the rear arm;

the carrier penetrates the housing through the carrier hole, the carrier being connected to the foot plate and to the pedal arm;

a compression spring disposed in the accommodation space between the lower side of the body of the housing and the carrier, wherein the compression spring includes:

a lower end being supported by the lower side of the body, the lower end being inserted in a lower hole of the lower side of the body, and an upper end inserted in an upper hole of a lower side of the rear arm to support the carrier to apply a restoring force to the carrier; and a cover coupled with the housing to cover an opening at a side of the housing, the cover including a center protrusion at a side of the cover, the center protrusion being inserted in a center part of the carrier and serving as a rotating fulcrum.

2. The accelerator pedal as set forth in claim 1, wherein the first end of the foot plate includes a hinge film inserted in the coupling hole to serve as a hinge.

3. The accelerator pedal as set forth in claim 1, wherein the flange formed at both side surfaces of the cylindrical part is inserted in flange holes formed in the body of the housing and the cover to be coupled therewith.

4. The accelerator pedal as set forth in claim 3, wherein a bushing is inserted between the flange and the flange holes.

* * * * *